United States Patent [19]

Fuhrman et al.

[11] Patent Number: 4,878,370

[45] Date of Patent: Nov. 7, 1989

[54] COLD EXTRUSION PROCESS FOR INTERNAL HELICAL GEAR TEETH

[75] Inventors: William J. Fuhrman, Bloomfield Hills; Daniel W. Hall, Plymouth; John C. Schneider, Detroit, all of Mich.

[73] Assignee: Ford Motor Company, Dearborn, Mich.

[21] Appl. No.: 232,042

[22] Filed: Aug. 15, 1988

[51] Int. Cl.[4] ..... B21C 25/06

[52] U.S. Cl. ..... 72/264; 72/253.1; 72/260

[58] Field of Search ..... 72/253.1, 256, 260, 72/264, 273.5; 29/159.2

[56] References Cited

U.S. PATENT DOCUMENTS

| | | | |
|---|---|---|---|
| 3,566,651 | 3/1971 | Tlaker | 72/76 |
| 3,910,091 | 10/1975 | Samanta | 72/256 |
| 4,287,749 | 9/1981 | Bachrach et al. | 72/467 |
| 4,350,865 | 9/1982 | Bachrach | 219/69 |
| 4,509,353 | 4/1985 | Ike et al. | 29/159.2 |
| 4,546,635 | 10/1985 | Arita et al. | 72/256 |
| 4,622,842 | 11/1986 | Bachrach et al. | 72/467 |

FOREIGN PATENT DOCUMENTS

| | | | |
|---|---|---|---|
| 2325837 | 12/1973 | Fed. Rep. of Germany | 29/159.2 |
| 3433515 | 4/1985 | Fed. Rep. of Germany | 72/264 |
| 257920 | 12/1985 | Japan | 72/256 |
| 195724 | 8/1986 | Japan | 29/159.2 |

*Primary Examiner*—Robert L. Spruill

*Attorney, Agent, or Firm*—Donald J. Harrington; Keith L. Zerschling

[57] ABSTRACT

A cold extrusion process for forming internal ring gears comprising the formation of an annular ring gear blank having precise inside and outside diameters, placing the workpiece over a circular mandrel having external gear forming die teeth and a pilot portion adapted to receive the blank, placing a die ring around the mandrel and the assembled workpiece, a circular punch arranged coaxially with respect to the mandrel and the workpiece, moving the punch into the annular space occupied by the workpiece between the die ring and the mandrel, advancing the punch by means of a press whereby the workpiece is cold formed through the external teeth of the mandrel, moving the die ring in synchronism with the downward motion of the workpiece through the die teeth thereby eliminating any frictional forces in the direction of motion of the die during the extrusion process, and retracting the die ring following the extrusion of the workpiece thereby permitting automated ejection of the workpiece.

6 Claims, 3 Drawing Sheets

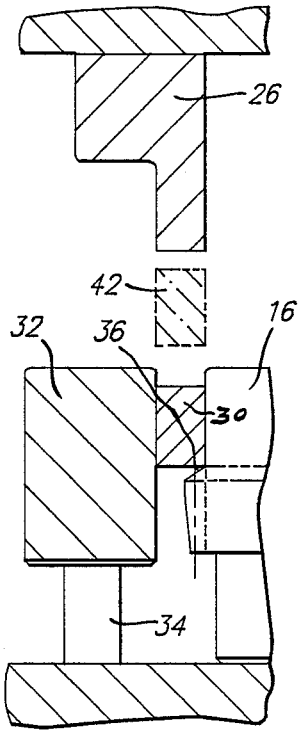
FIG. 4B.
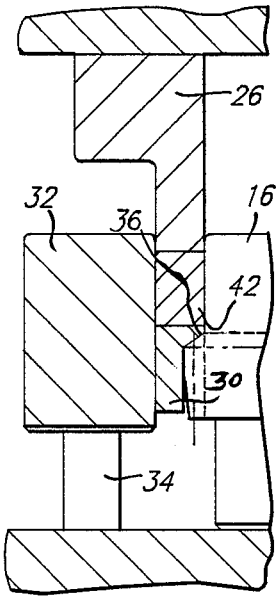
FIG. 4C.
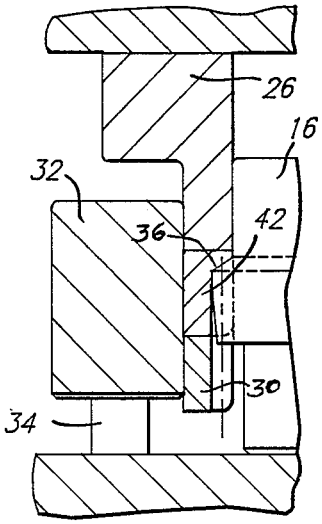
FIG. 4A.
FIG. 4D.
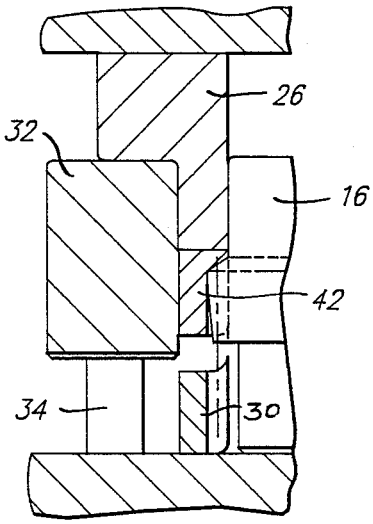
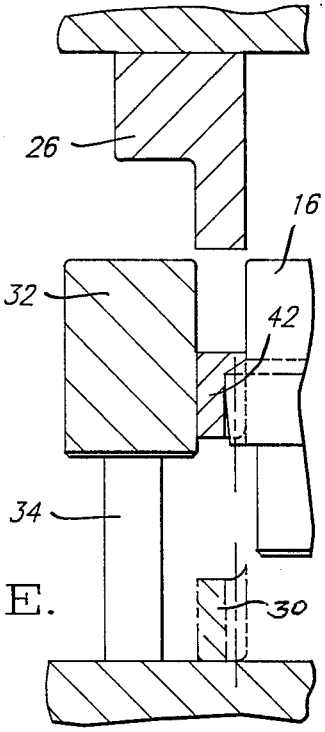
FIG. 4E.

COLD EXTRUSION PROCESS FOR INTERNAL HELICAL GEAR TEETH

BACKGROUND OF THE INVENTION

Our invention comprises improvements in the invention described in co-pending patent application Ser. No. 229,405, filed Aug. 8, 1988 by William J. Fuhrman, one of the co-inventors of this invention. The invention of the earlier application of William J. Fuhrman comprises a method for forming internal teeth for a ring gear by advancing an annular workpiece across external die teeth of a floating mandrel that is surrounded by a die ring.

The workpiece of the Fuhrman invention is extruded through the die teeth by a punch that is actuated by a ram, the punch entering the annular space between the mandrel and the die ring. As the punch is advanced, the workpiece is extruded throughout a major portion of its axial length. The punch then is withdrawn to permit entry of a second workpiece in registry with the first workpiece in end-to-end relationship. The second workpiece is received over a pilot portion of the mandrel. Subsequent movement of the punch advances the second workpiece, which in turn advances the partially extruded workpiece until the latter is fully extruded and moved beyond the location of the external die teeth of the mandrel.

During the extrusion of a workpiece using the process of the invention of the co-pending application of William J. Fuhrman relatively large friction forces occur because of the necessity of the workpiece, during the extrusion process, to slide along the annular inner surface of the die ring. If the workpiece is made of steel—for example, SAE 5130 steel—a relatively large and costly extrusion press is required. This is due partly to the high friction forces that are established during the extrusion process. In a typical embodiment the extrusion forces may be 240 tons or more.

In the extrusion process of the invention of the co-pending William J. Fuhrman application as well as in the present invention, the workpiece is caused to enter the entrance portion of the die teeth of the mandrel as the extrusion of metal begins. The entry of the workpiece is facilitated by a ramp portion on the leading edge of the die teeth adjacent to the pilot portion of the mandrel. The actual internal tooth formation region of the external teeth is only a fraction of the total die tooth length of the mandrel teeth. The trailing edge portions of the teeth are recessed to provide a progressively decreasing outer diameter. They also are formed with a progressively decreasing tooth thickness. This permits the die teeth of the mandrel to guide the workpiece during the extrusion process, but it avoids excessive friction forces between the teeth of the mandrel and the metal that is being extruded on the inside diameter region of the workpiece.

In our improved invention we have reduced substantially the friction forces that are required during the extrusion process. We have done this by making provision for movement of the die ring in unison or synchronism with the movement of the workpiece as the latter is extruded through the die teeth. After the die teeth fully extrude the internal teeth of the workpiece, the workpiece that is inserted in end-to-end relationship with respect to the extruded workpiece as well as the mandrel are raised by pneumatic cylinder rods without any relative motion occuring between the workpiece and the die ring. As the ring, the mandrel and the workpiece are raised, the extruded workpiece is stripped and ejected from the press. As the mandrel, the die ring and the partially extruded workpiece then are returned to a lower level, a subsequent workpiece can be inserted above the mandrel pilot portion and the foregoing method steps are repeated in the same sequence.

BRIEF DESCRIPTION OF THE FIGURES OF THE DRAWINGS

FIG. 3 is a view showing the elements of the extrusion press employed in our extrusion process.

FIGS. 4A through 4E show the structure of FIG. 3 in its various operating positions for the steps used in the extrusion process.

PARTICULAR DESCRIPTION OF THE INVENTION

Figure 1:
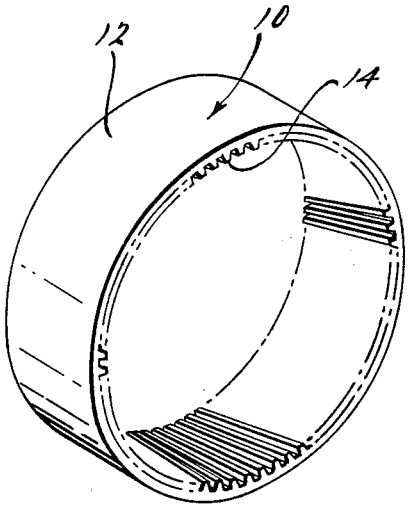
FIG. 1 is a view showing a finished ring gear made by the process of our invention.
Figure 2:
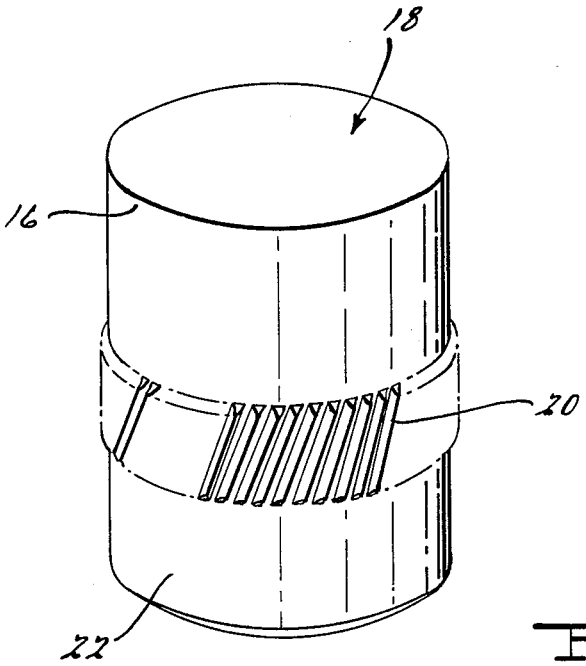
FIG. 2 is a view showing the external tooth mandrel used in the extrusion of the ring gear of FIG. 1.
Figure 2:
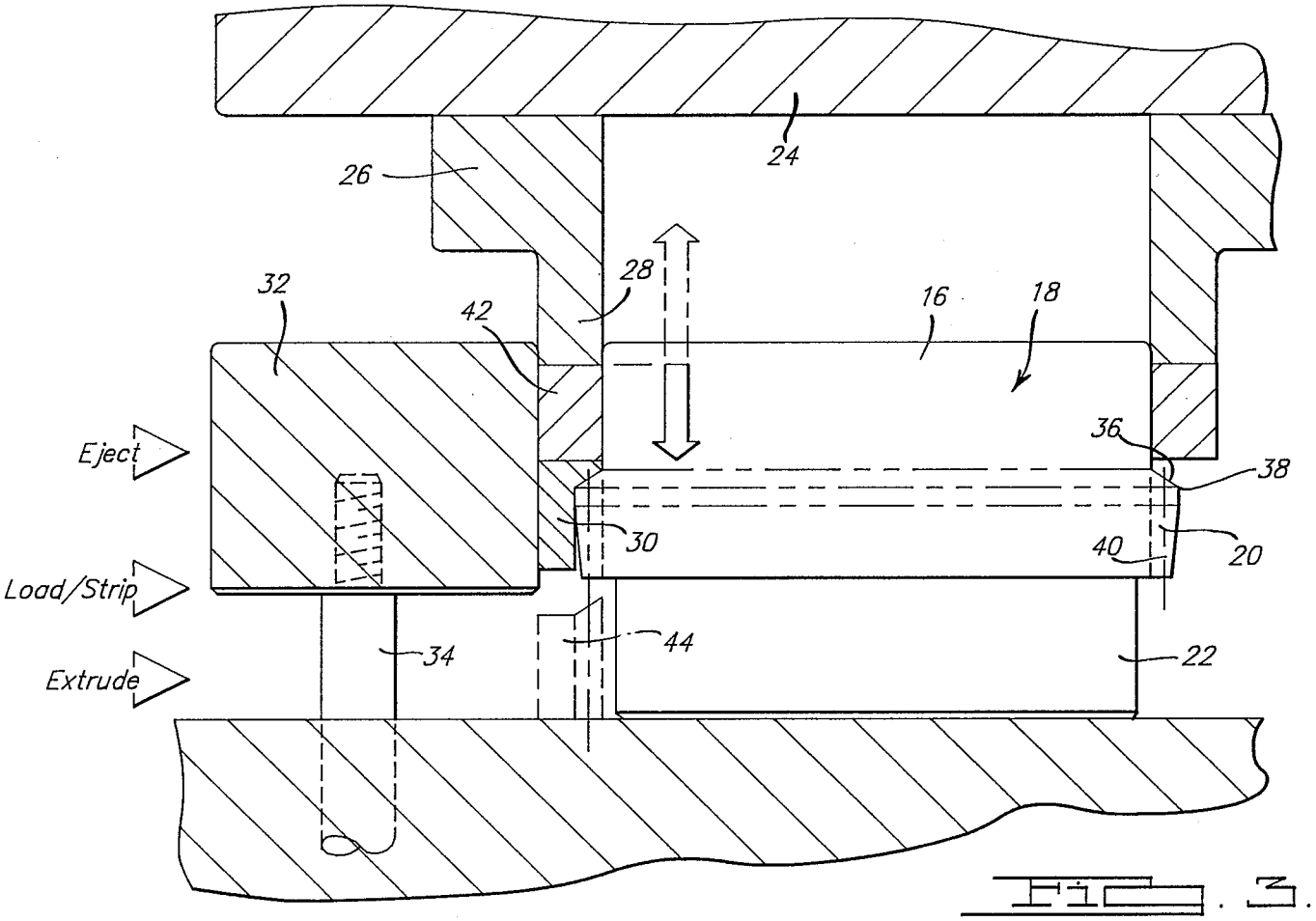

In FIG. 1 the ring gear is designated generally by reference character 10. It includes an annular shell 12 of precise diameter and internal helical gear teeth 14 which are extruded during the process. The workpiece from which the ring gear 10 is formed during the extrusion process is an annular ring with precision machined outside and inside diameters. It is fitted over a pilot portion 16 of the mandrel shown generally at 18 in FIG. 2. Mandrel 18 is a cylindrical member on which are formed external die teeth 20, the shape of which will be described with respect to FIG. 2. The mandrel includes also a support portion 22 which is adapted to be seated on a press bed capable of accommodating the considerable gear tooth extrusion forces.

As explained in the co-pending patent application of William J. Fuhrman, the ring gear 10 may be extruded from an aluminum alloy material if the gear forces that would act on the teeth are relatively small. If higher gear forces are required, the ring gear stock should be steel, such as SAE 5130 steel. In either case, the metal of the workpiece is extruded through the die teeth 20 as metal is displaced. This, of course, increases the axial length of the workpiece, and that axial growth is taken into account in the precision machining of the blank.

In FIG. 3 the hydraulic press is generally designated by reference numeral 24. It has secured thereto an annular punch 26 having a lead end portion 28 with radial dimensions equal to the radial dimensions of a workpiece 30.

Mandrel 18, as well as the workpiece 30, are received in a die ring 32 having a precision machined inside diameter that matches the outside diameter of the workpiece 30. Die ring 32 is supported by cylinder rods, one of which is shown at 34.

Die teeth 20 on the mandrel include a lead in tapered portion 36, a metal extruding portion 38 and a relief portion 40. Relief portion 40 is formed with a progressively decreasing outside diameter, and the teeth of the relief portion 40 are formed with a progressively decreasing width in comparison with the corresponding dimensions of the gear extruding portion 38.

When the punch 26 is withdrawn, a second workpiece 42 is inserted over the pilot portion 16 in end-to-end, juxtaposed relationship with respect to the workpiece 30. As the punch 26 then is advanced, workpiece 42 advances the workpiece 30 through the extrusion die teeth 20 until it is ejected at the lower portion of the assembly as shown at 44. When the workpiece 30 is being extruded through the die teeth 20, the die ring 32 moves in unison with the workpiece thereby preventing relative sliding movement of the workpiece with respect to the inner surface of the die ring 32. This eliminates any frictional forces that normally would be accompanied by such sliding motion. The total extrusion forces that are required then are reduced in magnitude.

In FIGS. 4A through 4E we have illustrated the sequence of the various steps during the extrusion process. In FIG. 4A the die punch is in the upper or retracted position. At that time a workpiece 42 is inserted over the pilot portion 16 of the mandrel. The die ring 32 is moved to an upward position by hydraulic cylinder rods 34. The preceding workpiece 30 is shown in FIG. 4A assembled over the pilot portion 16.

In FIG. 4B the punch 26 advances, thereby forcing the workpiece 42 against the workpiece 30 and extruding the latter through the teeth 20. When the positions of the workpieces assume that illustrated in FIG. 4B, the die ring 32 begins to move in unison with workpiece 36 until the movable parts assume the position shown in FIG. 4C. At that time the workpiece 30 is fully extruded, and the workpiece 42 is only partially extruded. In the next step the die ring 32, together with the partially extruded workpiece, are moved upwardly by the hydraulic piston rods as the extruded workpiece is stripped from the teeth. Continued movement of the die ring upwardly is accompanied by vertical movement of the mandrel until the parts assume the position shown in FIG. 4E. Continued movement of the punch ring 26 allows the loading of another workpiece as illustrated in FIG. 4A, and the cycle is repeated.

It is thus seen that with the ram and the punch in the upward position the blank may be initially preloaded over the pilot diameter of the mandrel into the cavity defined by the mandrel and the surrounding ring. During downward travel and in timed motion with the die ring, the punch axially forces the blank material into the entrance ramp and the tooth area of the mandrel. It stops movement when the workpiece is about 0.06 inches short of contact of the teeth of the mandrel. At that time the blank is maintained with high frictional contact between the mandrel and the die ring. As the punch and the die ring retract to the upward position the blank is partially stripped from the ring and a subsequent blank then is loaded in end-to-end relationship with respect to the preceding blank. Downward motion of the punch then forces the second blank into engagement with the partially extruded blank until the latter is fully extruded through the mandrel teeth. At that time the extruded workpiece drops free into the recess cavity where it can be ejected as shown in FIG. 4E.

As the punch retracts, the cylinder rods rise in unison with the other movable portions of the system into the position shown in FIG. 4E. At that time access is provided for a robotic arm, for example, to slide the extruded workpiece from the confines of the tooling. After ejection, the cylinders return the assembly to the original position.

The mandrel is a floating mandrel, and because of it is self-centering. The blanks are precision machined because any eccentricity that might be built into the blank in the pre-extruded state would result in a corresponding eccentricity of the extruded part.

The hole diameter of the pre-extruded workpiece blank must correspond to the minor diameter of the gear teeth. This ensures that the space between the teeth will be completely filled by the blank material during the extrusion process. Concentricity of the extruded pitch diameter is determined by the concentricity of the pre-extruded blank.

The tapered relief of the teeth and the progressively decreasing tooth thickness of the mandrel teeth discourage metal build-up and galling while serving the function of helical guidance in the case of the extrusion of helical teeth. We contemplate, however, that our improved process may be used to form spur gear teeth as well.

Having described a preferred embodiment of our invention, what we claim and desire to secure by U.S. Letters Patent is:

1. A process for cold extruding internal ring gear teeth comprising the steps of machining an annular ring gear blank with precision inside and outside diameters;

mounting said gear blank over a mandrel arranged coaxially with respect to said blank, said mandrel having external die teeth with metal forming portions and a relief portion of pitch diameter and tooth thickness less than the corresponding dimensions of the metal forming portions;

mounting a die ring around said mandrel and blank, said die ring having an inside diameter equal to the desired outside diameter of the finished ring gear;

moving an annular punch between said die ring and said mandrel whereby said workpiece is extruded partially through said die teeth;

mounting a subsequent workpiece over said mandrel adjacent the aforesaid workpiece in abutting relationship with respect to the latter;

and moving said die ring in unison with the workpiece being extruded thereby reducing the total extrusion force required and eliminating the possibility of scoring of the workpiece and die ring at the surface-to-surface interface.

2. The combination as set forth in claim 1 wherein said mandrel is mounted on a die bed with a free floating characteristic whereby the extruding motion of said workpiece is accompanied by rotary movement of said mandrel to accommodate any lead angle for helical teeth for the ring gear.

3. A process for cold extruding internal ring gear teeth comprising the steps of machining an annular ring gear blank with precision inside and outside diameters;

mounting said gear blank over a mandrel arranged coaxially with respect to said blank, said mandrel having external die teeth with metal forming portions and a relief portion of pitch diameter and tooth thickness less than the corresponding dimensions of the metal forming portions;

mounting a die ring around said mandrel and blank, said die ring having an inside diameter equal to the desired outside diameter of the finished ring gear;

moving an annular punch between said die ring and said mandrel whereby said workpiece is extruded partially through said die teeth;

mounting a subsequent workpiece over said mandrel adjacent the aforesaid workpiece in abutting relationship with respect to the latter;

moving said die ring in unison with the workpiece being extruded thereby reducing the total extrusion force required and eliminating the possibility of scoring of the workpiece and die ring at the surface-to-surface interface;

and means for retracting the die ring, the partially extruded workpiece and the punch to permit stripping of the extruded workpiece from the die ring.

4. The combination as set forth in claim 3 wherein said mandrel is mounted on a die bed with a free floating characteristic whereby the extruding motion of said workpiece is accompanied by rotary movement of said mandrel to accommodate any lead angle for helical teeth for the ring gear.

5. A process for cold extruding internal ring gear teeth comprising the steps of machining an annular ring gear blank with precision inside and outside diameters;

mounting said gear blank over a mandrel arranged coaxially with respect to said blank, said mandrel having external die teeth with metal forming portions and a relief portion of pitch diameter and tooth thickness less than the corresponding dimensions of the metal forming portions;

mounting a die ring around said mandrel and blank, said die ring having an inside diameter equal to the desired outside diameter of the finished ring gear;

moving an annular punch between said die ring and said mandrel whereby said workpiece is extruded partially through said die teeth;

mounting a subsequent workpiece over said mandrel adjacent the aforesaid workpiece in abutting relationship with respect to the latter;

and moving said die ring in unison with the workpiece being extruded thereby reducing the total extrusion force required and eliminating the possibility of scoring of the workpiece and die ring at the surface-to-surface interface;

means for retracting the die ring, the partially extruded workpiece and the punch to permit stripping of the extruded workpiece from the die ring;

and means for retracting the die ring and the partially extruded workpiece further together with said mandrel to permit ejection of the extruded workpiece from the tooling.

6. The combination as set forth in claim 5 wherein said mandrel is mounted on a die bed with a free floating characteristic whereby the extruding motion of said workpiece is accompanied by rotary movement of said mandrel to accommodate any lead angle for helical teeth for the ring gear.

* * * * *